US008192330B2

(12) United States Patent
Curley

(10) Patent No.: US 8,192,330 B2
(45) Date of Patent: Jun. 5, 2012

(54) YOGA MAT WITH INTUITIVE TACTILE FEEDBACK FOR VISUALLY IMPAIRED

(76) Inventor: Tracy Lynn Curley, Nantucket, MA (US)

( * ) Notice: Subject to any disclaimer, the term of this patent is extended or adjusted under 35 U.S.C. 154(b) by 0 days.

(21) Appl. No.: 13/011,414

(22) Filed: Jan. 21, 2011

(65) Prior Publication Data

US 2011/0118097 A1 May 19, 2011

Related U.S. Application Data

(63) Continuation of application No. 11/846,185, filed on Aug. 28, 2007, now Pat. No. 7,955,224.

(51) Int. Cl.
*A63B 21/00* (2006.01)

(52) U.S. Cl. ..... 482/51; D24/212

(58) Field of Classification Search ..... 482/51, 482/148; D24/212; D51/51
See application file for complete search history.

(56) References Cited

U.S. PATENT DOCUMENTS 5,096,188 A * 3/1992 Shen ..... 482/51
5,186,703 A * 2/1993 Huang ..... 482/148
D406,649 S * 3/1999 Miyake ..... D24/212
6,293,916 B1 * 9/2001 Alviso ..... 601/134
D471,636 S * 3/2003 Yu ..... D24/212
2004/0082890 A1 * 4/2004 Kuo ..... 601/134

* cited by examiner

*Primary Examiner* — Jerome W Donnelly
(74) *Attorney, Agent, or Firm* — Clock Tower Law Group; Erik J. Heels; Michael A. Bartley

(57) ABSTRACT

The invention includes an exercise mat that provides intuitive tactile feedback allowing a user to determine body placement using the sense of touch. The invention enables visually impaired users to determine location and/or direction on the mat. The invention includes devices to assist a user in correct foot and hand placements during a yoga posture sequence, an exercise program, a dance routine, and so forth. Tactile markers for hand and foot placement enable discerning a reference marker as either intended for hand or foot, right side or left side, and forward or backward. The invention makes yoga more accessible to the visually impaired and enables a user to participate in mainstream yoga communities. The invention can be used for the practice of yoga in a class setting in schools for the blind, in public or private studios, or at home. The mat can be used in a yoga class to follow instructions with more ease and independence. The pliable nature of the mat allows it to be easily portable to schools, studios, and storage at home.

12 Claims, 3 Drawing Sheets

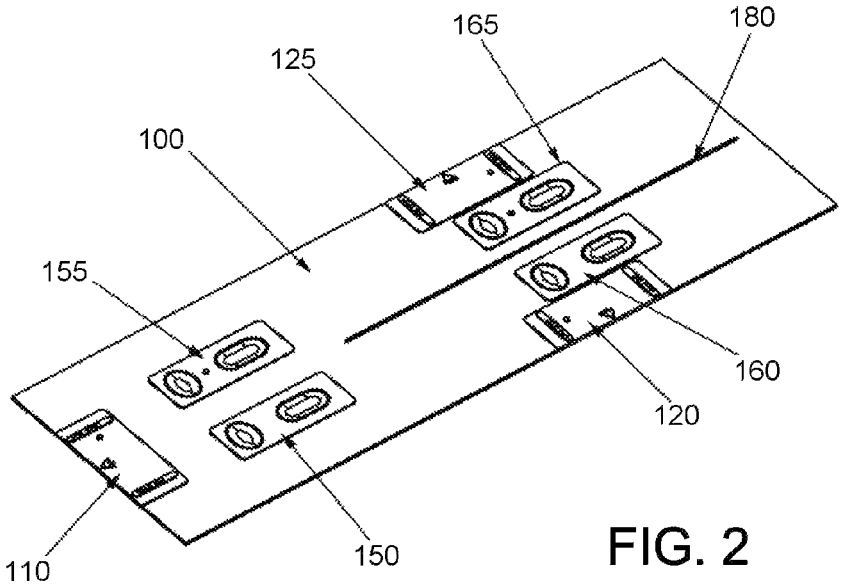
FIG. 2
FIG. 3a
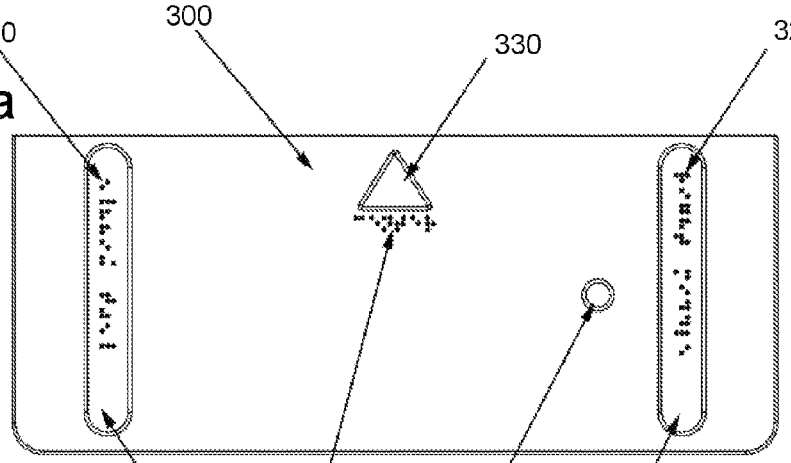
FIG. 3b
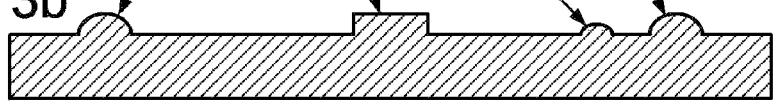

YOGA MAT WITH INTUITIVE TACTILE FEEDBACK FOR VISUALLY IMPAIRED

CROSS-REFERENCE TO RELATED APPLICATIONS

This application is a continuation of U.S. patent application Ser. No. 11/846,185, filed Aug. 28, 2007 now U.S. Pat. No. 7,955,224, titled "Yoga Mat With Intuitive Tactile Feedback For Visually Impaired" in the name of Tracy Lynn Curley, which is hereby fully incorporated by reference.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. Copyright 2011 Tracy Lynn Curley.

BACKGROUND OF THE INVENTION

1. Field of the Invention

The invention relates to exercise mats, and relates particularly to yoga mats.

2. Background

Yoga, or Hatha Yoga, is commonly associated with a practice having mental and physical benefits for the human body. Practicing yoga postures releases chronic tension, lengthens and strengthens muscles, and increases self-awareness. Yoga participants routinely practice in bare feet on a non-skid surface. Practicing yoga safely involves beginning with proper or optimal body alignment. Teaching yoga effectively involves using both verbal and visual cues, as well as physically assisting a participant when in a studio setting.

Yoga is not generally available as an activity to the blind community, nor is yoga being shared at schools for the blind. Practicing yoga by the blind or visually impaired is challenging. A sense of body alignment is more challenging for the visually impaired than for a sighted person. Lack of visual reference points makes proper body alignment for yoga postures more difficult to achieve without physical assistance from an instructor. Balance during yoga postures can also be difficult for the visually impaired. These challenges can be frustrating to a visually impaired participant, and time consuming in a class setting.

3. Description of Prior Art

Yoga mats are available in many shapes, colors, designs, and materials. There exist exercise and yoga mat designs having graphics and grids to assist sighted persons in proper body alignment and to assess incremental improvements in flexibility. Using such graphical indicia, however, does not permit a visually impaired person to be sure of proper body alignment, nor to gage where he or she is located on a mat.

There are a number of patent documents that describe exercise and yoga mats.

U.S. Pat. No. 6,387,013 issued to Marquez (May 14, 2002) and titled "Exercise Alignment System," discloses an exercise mat system for providing reference to an individual performing yoga exercises. The mat includes intersecting centerlines and several additional lines parallel to the centerlines. Marquez discloses an alternative embodiment that has extended side portions on opposite sides of the mat. While the mat of Marquez provides a visual reference for hand and feet position, this mat does not enable a visually impaired user to reference body placement on the mat during a yoga exercise.

U.S. Pat. No. 6,663,537 issued to McCoy (Dec. 16, 2003) and titled "Exercise Mat," discloses a non-slip exercise mat for use on multiple surfaces. The mat includes anchor bars and hook and loop bottom surface at the mat ends as a means for removably adhering the mat to carpeted surfaces. The anchor bars are removed for using the mat on non-carpeted surfaces. While the mat of McCoy provides a measure of safety for yoga participants, the mat of McCoy does not provide a reference means for use by visually impaired yoga participants.

U.S. Patent Application Publication 2003/0017915 by Prinzmetal (Jan. 23, 2003) and titled "Mat," discloses a mat for use with floor exercises. The mat includes intersecting centerlines, a pair of hand references zones, and a pair of foot reference zones. Reference zones for hand and foot are made of vertical and horizontal utility strips. Utility strips may be fixed, or may be removable and repositionable to mark incremental improvements. While the mat of Prinzmetal can assist yoga participants with alignment and measurement, the mat of Prinzmetal does not assist a visually impaired person to identify location on a mat to assist in proper body alignment.

U.S. Patent Application Publication U.S. 2004/0214692 by Koenig (Oct. 28, 2004) and titled "Grid On An Exercise Product And Exercise System Therewith," discloses an exercise mat having intersecting straight lines and sequential reference indicia. The mat of Koenig provides a grid of marks. Lines in the grid of marks can be visibly different in color, thickness and type (such as dashed lines), and can have a convex or concave protrusion from the surface of the exercise mat to differentiate one mark from another. The grid of lines may be used to assist in exercise alignment, to measure stretching progress from one week to another week, or to identify correct dance movements. While the mat of Koenig provides a simple, visual reference grid with some non-visual attributes, the visual indicia are necessary for proper use of the mat. The mat of Koenig does not provide the visually impaired an adequate means for easily, properly, and safely practicing complicated body positioning that yoga requires.

U.S. Patent Application Publication U.S. 200410229731 by Mitchell (Nov. 18, 2004) and titled "Exercise Mat With Printed Indicia Thereon," discloses a low impact exercise mat. The exercise mat has two sets of printed indicia. One set of indicia is to identify a location on the mat, while the second set is used to identify direction on a mat. The mat can be used to follow an exercise regimen for associative learners, visual learners, mathematical learners, spatial learners, auditory learners, kinesthetic learners, interactive learners. The mat of Mitchell uses printed indicia and relies on visual cues. The mat of Mitchell does not enable a visually impaired person to achieve proper body alignment using the mat.

U.S. Pat. No. 6,935,382 issued to Buckley (Aug. 30, 2005) and titled "Exercise Rug With Contours," discloses a woven exercise rug. The exercise rug has contours on an exercise surface to reduce the chance of a user slipping during an exercise. The woven material provides moisture relief and contours provide additional gripping for the user of the rug to help reduce the chance of slipping due to perspiration. Buckley, however, does not address the needs for establishing proper body alignment and enabling visually impaired users to identify proper positioning.

U.S. Patent Application Publication 2006/0073305 by Kole (Apr. 6, 2006) and titled "Yoga Mat," discloses a yoga mat having several arms. The yoga mat has a central segment from which a plurality of substantially equidistant arms extend outwardly. The mat of Kole enables a mat user to practice a variety of yoga positions without needing to reposition the mat. Kole, however, does not address the needs for establishing proper body alignment and enabling visually impaired users to identify proper positioning.

U.S. Pat. No. 7,108,635 issued to Howlett-Campanella (Sep. 19, 2006) and titled "Yoga Mat With Body Contact Placement Indicia," discloses a mat having a symmetrical body placement guide. The guide is imprinted on an upper surface of the mat, and is used to aid a yoga participant with proper body alignment during yoga postures, as well as tracking flexibility progress. The body placement guide includes a pattern design, a longitudinal axis and transverse axis that define four quadrants. While the mat of Howlett-Campanella aids a sighted uses with alignment, this mat does not enable a visually impaired user to reference body placement on the mat during a yoga exercise.

U.S. Pat. No. 7,069,607 issued to Nichols (Jul. 4, 2006) and titled "Absorbent Towel With Projections," discloses a yoga mat made from a towel. The towel includes a base layer and a plurality of raised projections that project away from the base layer. The projections are made from plastic, rubber, or epoxy and are used to provide grip to a floor surface. The top surface, as a towel material, is water absorbent to prevent slipping during yoga positions. The surface of the towel includes a focal region designed to be a visual focus point to assist with concentration and/or focus during the practice of yoga, martial arts or other sporting activities. While the towel of Nichols provides a measure of safety for yoga participants, the mat of McCoy does not provide a reference means for use by visually impaired yoga participants.

None of the above provides a yoga mat that enables visually impaired persons to safely and properly practice yoga. What is needed, therefore, is a yoga mat that overcomes the above-mentioned limitations and that enables visually impaired persons to identify correct hand and foot positioning without constant physical assistance from a yoga instructor.

BRIEF SUMMARY OF THE INVENTION

The present invention includes a yoga mat having intuitive tactile feedback features that enable a visually impaired person to feel location and direction on a mat for proper body alignment during the practice of yoga. The invention is preferably used for the practice of yoga, but can be used with other types of exercises or activities. The invention includes tactile hand-placement stations, feet-placement stations, and centerline. Placement stations are alternatively distinguishable by shape, elevation, convexity, concavity, texture, or other devices perceptible and discernable by touch. Placement stations may also contain Braille characters. Placement stations are easily distinguished for right, left, and center locations, and are easily distinguished between hand or foot locations. Placement stations also enable quick identification of the direction of the mat by touch. Tactile feedback from the mat enables a visually impaired participant to obtain proper body alignment by touch and to determine his or her location and direction on the mat during a yoga posture sequence.

For the visually impaired to practice yoga, without constant physical manipulation from an instructor, the yoga or exercise mat of the present invention has tactile features which enable a user to identify where the user's body is in relationship to the mat and to the user. To practice yoga correctly, a visually impaired user must be able to feel and to know simultaneously where the user's body is in relation to the yoga mat and in relation to other body parts. The user must be able to distinguish left from right hand and foot placement on a mat.

The mat itself can be constructed of any material and in any shape such as rectangle, square, and circle. The mat is best embodied as a generally rectangular mat having a non-skid top surface with convex and concave hand and foot marks, or elevated and recessed hand and foot marks. It is also best to have a raised centerline defining sides of the mat.

In one embodiment, an exercise mat has a substantially flat upper surface and devices for hand and foot placement located on the upper surface. A reference, device, mark, or station that is located on the surface of a mat means that the device is perceptible by touch on the surface of a mat. The device itself can be affixed on the mat, in the mat, integral with the mat, or otherwise. A hand placement device is tactilely discernible as a reference for a hand, and a foot placement device is discernible as a reference for a foot. That is the hand and foot placement devices are physically different such that, without a visual reference, a user of the mat can discern by touch (or be taught to discern by touch) whether the user is touching a hand placement device or foot placement device. Physical differences between the placement device and the upper surface of the mat include raised or recessed surfaces or shapes, convex and concave shapes, and differing surface textures without any relative elevation change. Placement devices may also contain braille characters as a tactile reference identifier. Alternatively, braille characters can be located anywhere on the mat, separate from placement devices, or as the primary placement device for a mat. A raised or recessed centerline can be added to provide an additional reference device.

In another embodiment, an exercise mat has a tactilely discernible hand placement mark, and tactilely discernible marks for left foot and right foot. In this embodiment, the foot marks are physically different such that left and right sides are perceptible by touch. For example, the foot marks could embodied as different shapes, or the foot marks could be identical shapes with different texture, or one of the foot marks could contain an additional physical mark to differentiate a side. Alternatively, the device to differentiate left and right foot marks is a raised centerline running between the foot marks. The foot marks are still distinguishable as a reference mark for the foot, but the raised centerline is use as a reference to distinguish between sides. The exercise mat can have a second set of foot reference marks and one or more additional hand placement marks positioned in a rear portion of the mat. Any combination of physical differences can be used to distinguish a mark as intended for a hand or foot, or positioned in a forward or rearward portion of the mat. For example, a raised center line could be absent in a forward end of the mat, and present in a rearward end of the mat. Reference devices, marks, or stations can include any reference for tactilely identifying, on an exercise or yoga mat, any combination of location, direction, side, or intended body part (hand/foot).

FEATURES AND ADVANTAGES

The benefits of yoga are available for everyone. The visually impaired have been underserved by the yoga community. The present invention, however, brings the gifts of yoga to a demographic that will benefit immensely from proper body alignment, increased balance, body awareness, stress reduction, self-confidence, and a new activity to enjoy. The present invention makes yoga more accessible to the visually impaired and allows the user to participate in mainstream yoga communities. The invention can be used for the practice of yoga in a class setting in schools for the blind, in public or private studios, or at home. Participants can use the yoga mat in a yoga class and follow instruction with more ease and independence. The pliable nature of the mat allows it to be easily portable to schools, studios, and storage at home.

This invention allows the visually impaired participant to receive tactile feedback for hand and foot placements, while performing a yoga posture sequence. This invention enables the visually impaired participant to know where he/she is located on the mat and in which direction he/she is facing to receive proper and clear instruction during a yoga practice. With the use of this invention, the participant can practice yoga more independently and safely.

BRIEF DESCRIPTION OF THE DRAWINGS

FIG. 2 is perspective view of the yoga mat.

FIG. 3*a* is a top view of a hand placement station.

FIG. 3*b* is a staggered, sectional side view of a hand placement station.

DETAILED DESCRIPTION OF THE INVENTION, INCLUDING THE PREFERRED EMBODIMENT

Operation

The following detailed description of the invention references the accompanying drawings which form a part hereof, and in which are shown, by way of illustration, specific embodiments in which the invention may be practiced. Understand that other embodiments may be used, and structural changes may be made without departing from the scope of the present invention.

Figure 1:
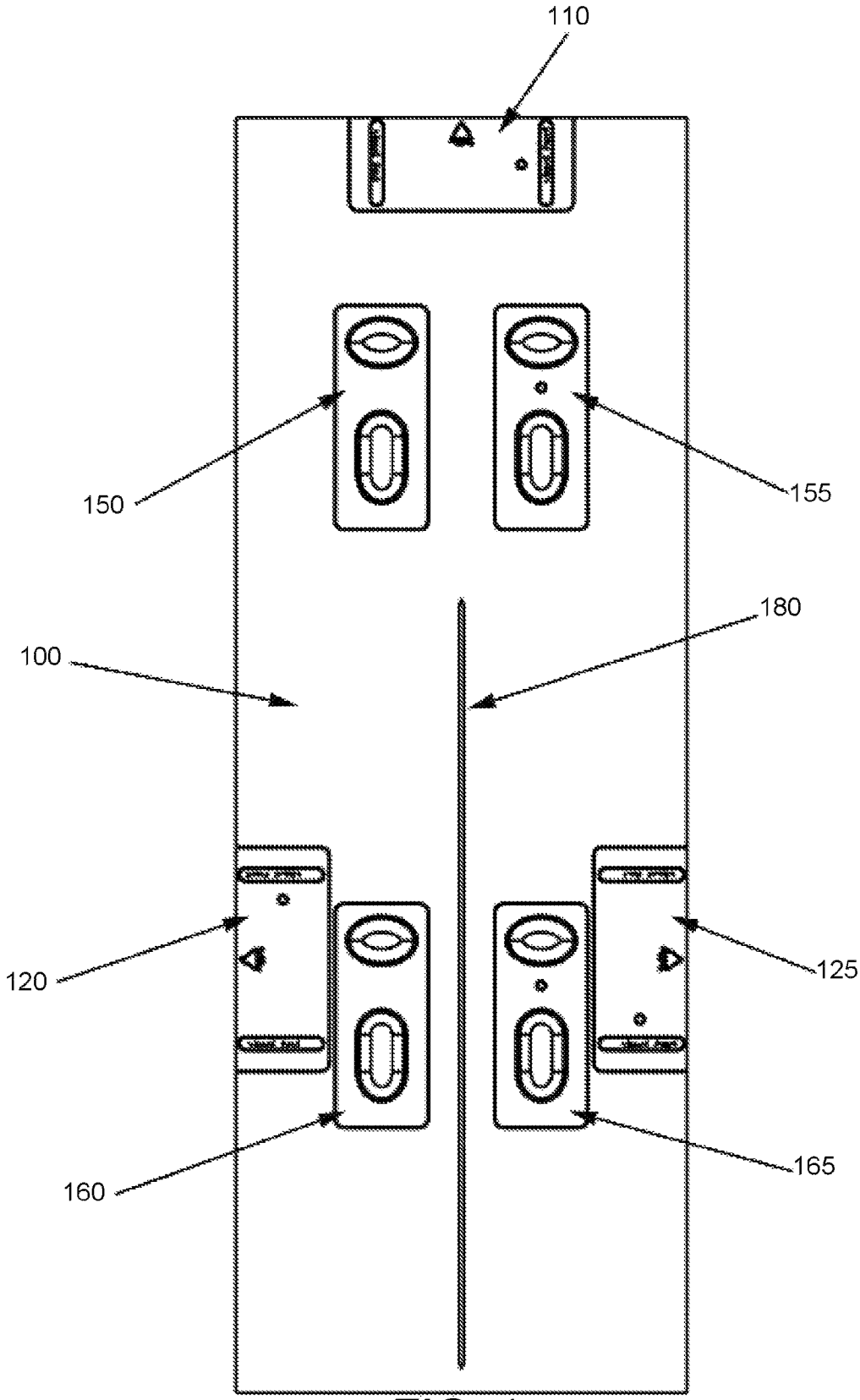
FIG. 1 is a top view of the yoga mat with the relative position of the hand placement, feet placement, and centerline contained in the preferred embodiment.

Referring to FIGS. 1 and 2, yoga mat 100 is constructed of one or more molded sheets of pliable material, and contains three hand placement stations, two left foot placement stations, two right foot placement stations and one centerline. Hand placement station 110 is centered at the head of mat 100. Hand placement station 120 is located on the left hand side of mat 100, and perpendicular to the head of mat 100. Hand placement station 120 has a center triangle located towards the edge of mat 100. Hand placement station 125 is located on the right hand side and turned perpendicular to the top of mat 100. Hand placement station 125 has a center triangle that is located at the edge of mat 100. Hand placement stations 120 and 125 are located on the same latitude, or equal distance from the head of mat 100, and face in opposing directions. There are two sets of foot placement stations in the preferred embodiment—a forward set and a rearward set, wherein the forward set is located towards the head of mat 100. Each set contains one right foot placement area and one left foot placement area. In the forward set, left foot placement station 150 and right foot placement station 155 are located parallel to one another in the forward half of mat 100 and at an approximate hip width distance apart. Left foot placement station 150 and right foot placement station 155 are located on the same latitude and facing in the same direction. In the rearward set, left foot placement station 160 and right foot placement station 165 are parallel to one another in the rearward half of mat 100 and at an approximate hip width distance apart. Left foot placement station 160 and right foot placement station 165 are located on the same latitude and face the same direction. Forward and rearward foot placement stations are located in line longitudinally with one another. Centerline 180 is raised and travels longitudinally down the center of the mat. Centerline begins near to the forward set of foot placement stations, and continues towards the rear of mat 100.

Referring to FIGS. 3*a* and 3*b*, hand placement station 300 is shown. Preferably, the yoga mat contains at least one hand placement station. Hand placement station 300 is preferably rectangular and includes finger bars 310 and 315, center triangle 330, and raised circle 350, which is raised relative to a surrounding surface of hand placement station 300. Braille characters 320, which read "left middle," are located on top of the convex finger bar 310. Hand placement station 300 is smooth and slightly raised above a pliable sheet material of mat 100 to provide a further tactile cue hand placement station 300. Center triangle 330 is convex, centered between finger bars 310 and 315, positioned near an edge of hand placement station 300. Braille characters 340, which read "center," are located adjacent to center triangle 330 and printed on top of hand placement station 300. Side identifying circle 350 is located to the left and center of right finger bar 315, and servers to further distinguish between right and left side, of hand placement station 300, by touch. Right finger bar 315 protrudes relative to the surface of hand placement station 300, and contains Braille characters 325 printed on top of finger bar 315, and which read "right middle."

Figure 4A:
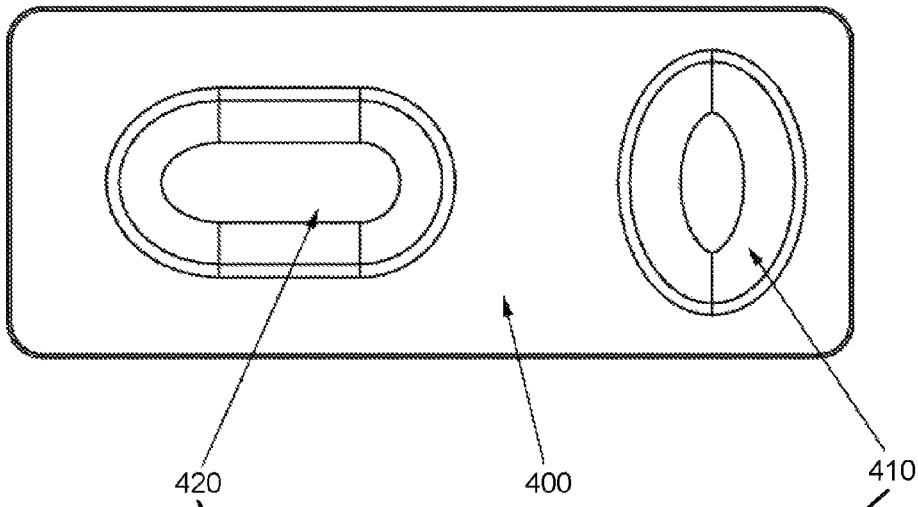
FIG. 4*a* is a top view of a left foot placement station.
Figure 4B:
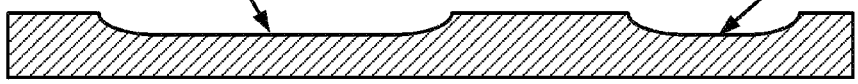
FIG. 4*b* is a sectional side view of a left foot placement station.

FIGS. 4*a* and 4*b* illustrate left foot placement station 400. Left foot placement station 400 is generally rectangular, smooth and slightly raised relative to the top surface of mat 100. Ball of foot mark 410 is an oval, concave depression located in a forward half of left foot placement station 400. Heel of foot mark 420 is an elongated oval, concave depression located in a rearward half of left foot placement station 400, and positioned perpendicular to ball of foot mark 410. The elongation of heel of foot mark 420 enables left foot placement station to accommodate feet of many sizes. With ball of the foot mark 410 and heel of foot mark 420 embodied as depressions, left foot placement station 400 provides arch support and stability support for the foot. Absence of other marks indicates that a foot placement station is designed to receive the left foot.

Figure 5A:
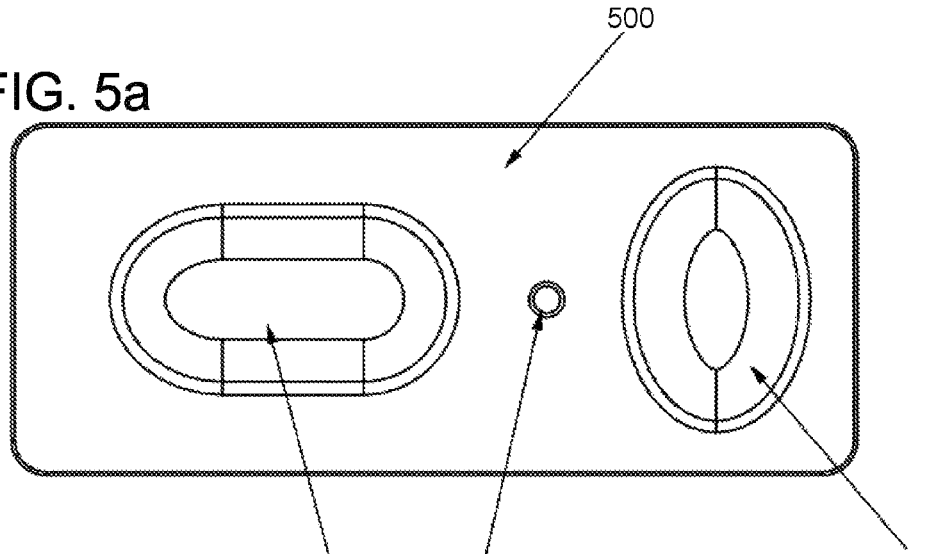
FIG. 5*a* is a top view of a right foot placement station.
Figure 5B:
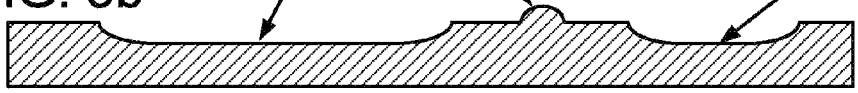
FIG. 5*b* is a sectional side view of a right foot placement station.

FIGS. 5*a* and 5*b* illustrate right foot placement station 500, which is similar to left with placement station 400. Right foot placement station 500 is generally rectangular, smooth and slightly raised relative to the top surface of mat 100. Ball of foot mark 510 is an oval, concave depression located in a forward half of right foot placement station 500. Heel of foot mark 520 is an elongated oval, concave depression located in a rearward half of right foot placement station 500, and positioned perpendicular to ball of foot mark 510. The elongation of heel of foot mark 520 enables right foot placement station to accommodate feet of many sizes. With ball of the foot mark 510 and heel of foot mark 520 embodied as depressions, right foot placement station 500 provides arch support and stability support for the foot. Right foot placement station 500 also includes raised circle 525. Raised circle 525 is located between ball of foot and heel of foot depressions to provide a tactile identifier for a right foot placement station.

Preferably, the exercise mat is molded in one piece. Placement stations are slightly or noticeably raised off the surface to provide a reference point for locating a placement station itself with hand or foot. Constructed of pliable material, the mat provides for easy storage and/or transport to a studio or class. The soft, rubber-like material provides support and stability to assist participants in correct foot position for balancing postures as opposed to the challenge of balancing on a cushioned surface.

A typical sequence of yoga postures uses the mat with a participant facing forward, sideways, and facing the direction of the rear of the mat during various instances of the sequence. It is important for the visually impaired user to know in which direction the user is facing to receive proper and clear instructions. The layout of the yoga mat of the present invention permits the user to identify the forward end of the mat by touch as the user feels the forward hand placement station. The rear portion of the mat has a raised centerline which can be used both to help differentiate forward and rearward end, and sides of the mat. Preferably, the sides of the mat are identical or substantially similar for use with sideway postures. Thus, a user can turn to either side and have similar, tactile foot and hand reference marks for practicing postures. Within the mat layout, the tactile right, left, and center cues are an additional support to navigate around the mat during yoga or exercise routines.

On the hand placement station, finger placements permit a participant to line up one hand with the other hand. This tactilely cues the participant and gives the participant a foundation on which to build in a sequence of stretching and yoga postures. The hand station location at the forward end of the mat cues the participant that the participant is facing the forward end of the mat. The hand station contains a center triangle. This triangle can be used independently to line up chin, forehead, or nose to feel one's head straight on one's shoulders, or can be used in conjunction with the raised centerline for floor postures.

The foot placement station contains two distinct depressions. A wider depression is for the ball of the foot, and a narrower elongated depression is for the heel of the foot. The elongated heel depression allows the foot station to be used by many foot sizes. The foot placement is directional in that foot placement stations are intended to be used facing in one direction. Embodied as directional foot placement station enables a participant to know in which direction the mat is facing, and minimizes confusion. Located on the right foot placement station in between the ball and the heel depressions is a raised circle to indicate right side. The left foot depression remains smooth. The circle shape is raised and intended to be felt by the foot when stepping on the insert. This further assists the visually impaired participant to establishing proper body alignment independent of physical manipulation and with more confidence.

Right foot and a left foot placement stations are located parallel to one another on the mat. In the preferred embodiment, the ball of foot mark in the right foot placement station is approximately 9 inches on center from the ball of foot mark in the left foot placement station, giving the participant an approximate structural hip width distance stance. Such a layout of the foot placement stations enables a participant to practice yoga postures which require feet to be in parallel position at hip width apart. Foot placement stations also enable knee placement while on the floor. Knees can rest in the ball of the foot mark to implement additional stretches or yoga postures such as Cat/Dog or modified Plank.

A second set of foot placement stations is located towards the rear of the mat. The rearward foot placement stations enable a participant to have one leg extended behind the participant (for example, in a lunge) while maintaining an approximate hip width distance as if the participant were standing on train tracks. The rearward foot placement stations enable the legs to be in proper alignment for additional yoga postures such as Warrior 1 and Lateral Angle. The rearward foot placement stations can be used in conjunction with the forward hand placement station to practice postures such as Downward Dog.

The raised longitudinal centerline permits a participant to obtain proper leg alignment for wide angled yoga postures when the participant is positioned sideways on the mat, or to follow instructions such as bringing the foot into a ninety degree angle, and lining up second or third toe with the heel. When using the centerline during standing yoga postures, the participant will generally begin perpendicular to the head of the mat. The participant places the ball of the feet on the centerline with legs in a wide stance to begin some yoga postures such as Triangle or Warrior 2.

Other Embodiments

There are several layout variations contemplated by the invention. For example, the raised centerline can be continuous or broken into two lines—one line forward of the rear foot placement station, and one line behind the station. Hand and foot placement station can be recessed or raised relative to the mat surface, and marking shapes in the placement stations themselves can be either recessed or raised relative to the surface of the placement station. Alternatively, placement stations can use any device that is perceptible by touch to differentiate the placement station from the mat. For example, the placement stations can have a different surface texture than the surface texture of the majority of the mat, or be constructed of a differing materials that are perceptibly different by touch. The placement stations can similar differences in shapes and marks to differentiate a placement station from other placement stations.

The mat can be constructed so that hand and foot placement stations are removable and exchangeable with placement stations of other designs. In another embodiment, number and location of placement stations can be varied depending on the nature of the exercise for which the mat is to be used. For example, if the mat were to be used primarily for karate instead of yoga, then hand and/or foot placement stations can be arranged to correspond to fundamental karate practices. Likewise, a different layout can be arranged for a mat designed primarily for use with dance routines.

Mats can be sized to accommodate children or extremely tall adults. Mats can vary in thickness and materials of construction. Mats can use custom shapes perceptible and discernable by touch to differentiate right and left sides, forward and rearward areas, and hand and foot placement stations. The mat of the invention can include an audio sensor feedback located on or in the hand and feet placement stations. For example, when a participant depresses a placement station, this triggers an electronic audio recording to sound "right foot" as an audio feedback response.

The invention claimed is:

1. An exercise mat comprising:

a mat structurally sufficient for the exercise of yoga having a substantially flat upper surface of pliable material, and a lower surface;

a first hand placement station located as part of the upper surface of the mat, wherein the first hand placement station is tactilely discernible to identify the first hand placement station as a location to position a hand, thereby providing a non-visual reference; and a first foot placement station located as part of the upper surface of the mat, wherein the first foot placement station is tactilely discernible to identify the foot placement station as a location to position a foot, thereby providing a non-visual reference;

a set of reference devices located as part of the upper surface of the mat, to differentiate forward and rearward ends and sides of the mat without requiring visual reference; and a tactilely discernible centerline running lengthwise as part of the upper surface of a center portion of the mat, wherein the tactilely discernible centerline is a continuous line which runs from one end of the mat towards but not all the way to an opposite end of the mat;

wherein the first hand placement station, first foot placement station, and reference devices are all tactilely discernible from one another.

2. The exercise mat of claim 1, wherein the hand and foot placement stations and reference devices comprise an elevated, recessed, or both elevated and recessed surface, relative to the substantially flat upper surface of the mat.

3. The exercise mat of claim 1, wherein the tactilely discernible placement stations comprise a surface texture that is tactilely discernible from the upper surface of the mat.

4. The exercise mat of claim 1, wherein the tactilely discernible placement stations comprise convex or concave shapes relative to the upper surface of the mat.

5. The exercise mat of claim 1, wherein the hand and foot placement stations include tactilely identifiable braille characters.

6. An exercise mat comprising:

a mat structurally sufficient for the exercise of yoga having a substantially flat upper surface of pliable material, and a lower surface, wherein the mat has a forward end, a rearward end, a left side and a right side;

a first hand placement station located as part of the upper surface of the forward end of the mat, wherein the first hand placement station is tactilely discernible to identify the first hand placement station as a location to position a hand, thereby providing a non-visual reference;

a first left foot placement station located as part of the upper surface of the left side of the mat, wherein the first left foot placement station is tactilely discernible as a reference for left foot placement, thereby providing a non-visual reference;

a first right foot placement station located as part of the upper surface of the right side of the mat opposite the first left foot placement station, wherein the first right foot placement station is tactilely discernible as a reference for right foot placement, thereby providing a non-visual reference; and a tactilely discernible centerline running lengthwise as part of the upper surface of a center portion of the mat, wherein the tactilely discernible centerline is a continuous line which runs between the first left foot placement station and first right foot placement station and extends from the rearward end of the mat towards but not all the way to the forward end of the mat;

wherein the hand placement station and foot placement stations are all tactilely discernible from one another.

7. The exercise mat of claim 6, further comprising a second left foot placement station as part of the upper surface of the mat, wherein the second left foot placement station is tactilely discernible as a reference for left foot placement, and a second right foot placement station located as part of the upper surface of the mat, wherein the second right foot placement mark is tactilely discernible as a reference for right foot placement.

8. The exercise mat of claim 6, further comprising a second hand placement station located as part of the upper surface of the rearward end of the mat, wherein the second hand placement station is tactilely discernible as a reference for hand placement, and a third hand placement station located as part of the upper surface of the rearward end of the mat, wherein the third hand placement mark is tactilely discernible as a reference for hand placement.

9. The exercise mat of claim 6, wherein each tactilely discernible placement station comprises an elevated or recessed surface, relative to the substantially flat upper surface of the mat.

10. The exercise mat of claim 6, wherein each tactilely discernible placement station comprises convex or concave shapes relative to the upper surface of the mat.

11. The exercise mat of claim 6, wherein a tactilely discernible placement station comprises convexities or concavities.

12. The exercise mat of claim 6, wherein the hand and foot placement stations include tactilely identifiable braille characters.

* * * * *